US009085915B1

(12) United States Patent
Emmett

(10) Patent No.: US 9,085,915 B1
(45) Date of Patent: Jul. 21, 2015

(54) WOODEN SUPPORT POST PROTECTION SYSTEM

(71) Applicant: Troy Emmett, Santa Clara, CA (US)

(72) Inventor: Troy Emmett, Santa Clara, CA (US)

( * ) Notice: Subject to any disclaimer, the term of this patent is extended or adjusted under 35 U.S.C. 154(b) by 0 days.

(21) Appl. No.: 14/199,069

(22) Filed: Mar. 6, 2014

(51) Int. Cl.
*E04H 12/22* (2006.01)

(52) U.S. Cl.
CPC ..... *E04H 12/2292* (2013.01)

(58) Field of Classification Search
CPC ..... E01F 15/0461; E01F 15/0453; E01F 15/0423; E01F 9/023; E01F 9/011; E01F 9/0116; E04H 17/1413; E04H 17/20; E04H 12/2292
USPC ..... 52/834–835, 842–843, 848, 169.9, 52/169.13–169.14
See application file for complete search history.

(56) References Cited

U.S. PATENT DOCUMENTS

| | | | | | |
|---|---|---|---|---|---|
| 2,195,275 | A | * | 3/1940 | Hansen | 405/216 |
| 3,321,924 | A | * | 5/1967 | Liddell | 405/216 |
| 4,244,156 | A | * | 1/1981 | Watts, Jr. | 52/746.1 |
| 4,697,957 | A | * | 10/1987 | Hellmers | 405/216 |
| 4,799,340 | A | | 1/1989 | Lichau et al. | |
| 4,910,901 | A | * | 3/1990 | Boyar | 40/607.06 |
| 5,138,806 | A | * | 8/1992 | Marx et al. | 52/170 |
| 5,175,032 | A | | 12/1992 | Steele et al. | |
| 5,315,796 | A | | 5/1994 | Gruhlke | |
| 5,328,743 | A | | 7/1994 | Wynne et al. | |
| 5,516,236 | A | * | 5/1996 | Williams et al. | 405/216 |
| 5,622,356 | A | | 4/1997 | Duggan | |
| 5,725,921 | A | | 3/1998 | Baecker et al. | |
| 5,733,613 | A | | 3/1998 | Baecker | |
| 5,919,004 | A | * | 7/1999 | Christenson | 405/216 |
| 6,098,351 | A | | 8/2000 | Mills | |
| 7,104,525 | B2 | | 9/2006 | Ricci | |
| 7,121,530 | B1 | * | 10/2006 | Preta | 256/65.04 |
| 8,256,184 | B2 | * | 9/2012 | Lowe | 52/741.3 |
| 2005/0005540 | A1 | | 1/2005 | Nesbitt | |
| 2005/0274938 | A1 | | 12/2005 | Nesbitt | |
| 2006/0186392 | A1 | * | 8/2006 | Keller et al. | 256/59 |
| 2013/0042547 | A1 | | 2/2013 | Carhart | |

FOREIGN PATENT DOCUMENTS

| | | |
|---|---|---|
| NZ | WO2004024443 | 3/2004 |

* cited by examiner

*Primary Examiner* — Jeanette E Chapman
(74) *Attorney, Agent, or Firm* — Thomas R. Lampe

(57) ABSTRACT

A wooden post protection system wherein a sheet metal sleeve is positioned about a portion of the post adjacent to concrete supporting the post, overlapping end segments of the post nailed to the post and an adhesive water-proof coating forming a water-tight bond between the post and sleeve and between the end segments and nails.

12 Claims, 2 Drawing Sheets

WOODEN SUPPORT POST PROTECTION SYSTEM

TECHNICAL FIELD

This invention relates to an apparatus and method for protecting a wooden support post embedded in concrete positioned in the ground. More particularly, the system is employed to decrease the rate of rot and deterioration of that portion of the wooden support post immediately adjacent to the concrete. The apparatus additionally functions as a protector from damage of the post by machinery such as mowers and weed eaters. The invention also acts as a barrier to prevent damage to the post by subterranean termites.

BACKGROUND OF THE INVENTION

It is well known that wooden posts used to support fencing and other structures are particularly prone to rot, fungus and other problems in and closely adjacent to the ground. Although concrete footings are often employed to mount wooden support posts and strengthen and stabilize the position of the posts, concrete footings do not significantly slow down or prevent deterioration of the post at or immediately above the concrete. Exposure to moisture and other factors still result in relatively rapid rot and deterioration of the post at the mounted end thereof. Wooden fence posts, when set in concrete, have a tendency to rot at grade-level, due to the more or less constant influx of moisture and the availability of micro-organisms at the surface of the ground.

The reason that wood posts rot is earth or soil contact at the base of the post where the concrete is set. Most people do not raise the concrete above the ground high enough to prevent dirt build up or the concrete is set below the dirt. The dirt (soil) retains moisture and fungus et cetera which retains the moisture which makes the post spongy.

The same conditions invite invasion of the post by termites.

Replacement of rotted wooden fence posts is an expensive and time consuming procedure. Consequently, numerous systems have been devised in an attempt to reduce and slow down rot and deterioration. Typically, such systems can be relatively ineffective and/or be expensive both in regard to the costly structures employed to provide protection as well as the time consuming and sometimes elaborate and complicated installation procedures involved.

The following patent documents are believed to be representative of the current state of the art in this field: U.S. Patent Pub. No. 2013/0042547, published Feb. 21, 2013, U.S. Pat. No. 7,104,525, issued Sep. 12, 2006, U.S. Pat. No. 5,622,356, issued Apr. 22, 1997, U.S. Pat. No. 5,138,806, issued Aug. 18, 1992, U.S. Pat. No. 5,315,796, issued May 31, 1994, U.S. Pat. No. 5,175,032, issued Dec. 29, 1992, U.S. Patent Publication No. US 2005/0274938, published Dec. 15, 2005, U.S. Pat. No. 5,725,921, issued Mar. 10, 1998, U.S. Patent Pub. No. US 2005/0005540, published Jan. 13, 2005, U.S. Pat. No. 5,733,613, issued Mar. 31, 1998, U.S. Pat. No. 5,328,743, issued Jul. 12, 1994, U.S. Pat. No. 4,799,340, issued Jan. 24, 1989, U.S. Pat. No. 6,098,351, issued Aug. 8, 2000 and PCT Pub. No. WO 2004/024443, published Mar. 25, 2004.

DISCLOSURE OF INVENTION

The present invention encompasses a system incorporating apparatus and a method for protecting against deterioration a portion of a wooden support post embedded in concrete positioned in the ground, the protected post portion located above the concrete at or immediately adjacent to the concrete.

The apparatus of the present invention is relatively simple and inexpensive as compared to conventional structures utilized for this purpose. Furthermore, installation of the apparatus utilized by practicing the method of the invention is readily accomplished with minimal effort and within a very short period of time.

The apparatus of the invention includes a protective sleeve of single piece construction formed of sheet metal extending completely about the peripheral surface of a post at a post portion located above the concrete at or immediately adjacent to the concrete. The sleeve has an upper sleeve edge and a lower sleeve edge, a sleeve inner surface and overlapping sleeve end segments defining holes.

An adhesive, water-proof coating is located between the sleeve inner surface and the post covering the post portion.

Mechanical fastener structure extends through the holes defined by the overlapping sleeve end segments and into the post portion exerting opposed pulling forces on the overlapping end segments tightening the sleeve about the post portion and compressing the adhesive, water-proof coating to form a water-tight bond between the sleeve and the post portion extending from the concrete to the upper sleeve edge.

The invention also encompasses a method for protecting a wooden support post having a peripheral surface of predetermined length and including a lower post end embedded in concrete positioned in the ground, the post projecting upwardly from the concrete and ground.

The method includes the step of providing a protective sleeve of single piece construction formed of sheet metal having an upper sleeve edge and a lower sleeve edge, a sleeve inner surface and overlapping sleeve end segments defining holes.

The sleeve is positioned so that the sleeve extends completely about the peripheral surface of the post at a post portion located above the concrete at or immediately adjacent to the concrete.

The method further includes the step of providing an adhesive, water-proof coating between the sleeve inner surface and the post to cover the post portion.

Also according to the method, mechanical fastener structure is extended through the holes defined by the overlapping sleeve end segments and into the post portion to exert opposed pulling forces on the overlapping end segments tightening the sleeve about the post portion and compressing the adhesive, water-proof coating to form a water-tight bond between the sleeve and the post portion extending from the concrete to the upper sleeve edge.

Other features, advantages and objects of the present invention will become apparent with reference to the following description and accompanying drawings.

PREFERRED MODE FOR CARRYING OUT THE INVENTION

Figure 1:
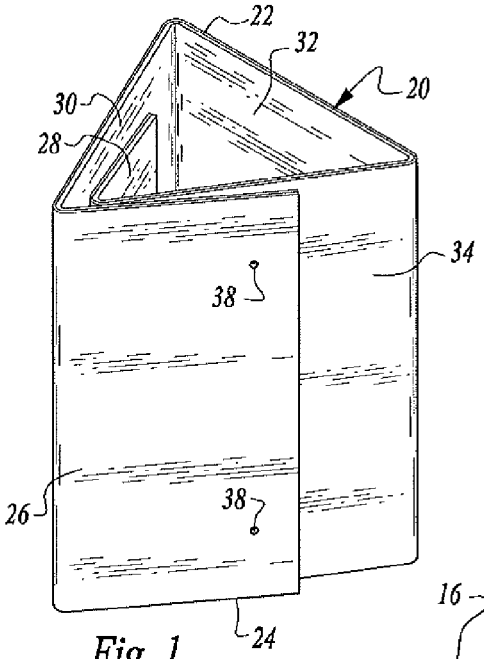
FIG. 1 is a perspective view of a protective sleeve of the invention prior to installation, the sleeve having an adhesive, water-proof coating applied to the inner surface thereof covered by a protective sheet.

Referring now to the drawings, a wooden support post 10 is illustrated. The post may be of any suitable size but it has a peripheral surface 12 of predetermined length, which may be, for example, the distance around the outer perimeter of a four by four or six by four. The principles of the present invention are applicable to wooden support posts of any type, whether square, non-square rectangles, or round.

In the drawings, the lower post end is embedded in concrete 14 positioned in the ground 16, as is a conventional practice. The post projects upwardly from the concrete and ground and includes a post portion 18 located above the concrete immediately adjacent thereto. It is this portion of a wooden support post embedded in concrete and in contact with soil above the concrete where deterioration and rot is most pronounced.

Figure 8:
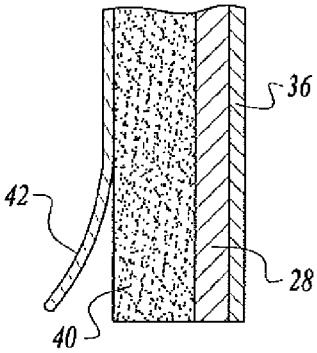
FIG. 8 is a greatly enlarged, cross-sectional view taken along line 8-8 of FIG. 2.
Figure 9:
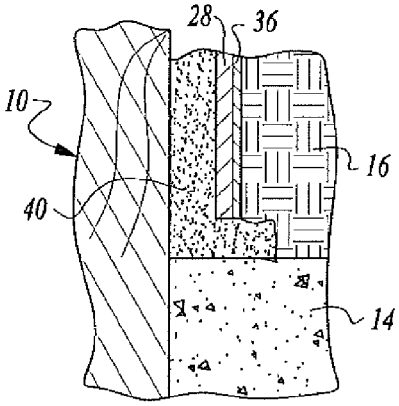
FIG. 9 is a greatly enlarged, cross-sectional view taken along the line 9-9 in FIG. 7.

The apparatus of the present invention includes a protective sleeve 20 of single piece construction formed of sheet metal, preferably galvanized sheet metal or aluminum. The sleeve 20 has an upper sleeve edge 22, a lower sleeve edge 24, a sleeve inner surface and overlapping sleeve end segments 26, 28 defining holes 28. Main panels 30, 32 and 34 of the sleeve are disposed between the sleeve end segments, the main panels and sleeve end segments being interconnected by linear bends in the sleeve. FIG. 1 shows the configuration of the sleeve when outside forces are not exerted thereon. Preferably, the outer surface of the sleeve is powder coated. The enlarged views of FIGS. 8 and 9 illustrate the coating 36.

In the arrangement illustrated, each sleeve end segment has two spaced holes 38 in vertical alignment on the end segment.

An adhesive, water-proof coating 40 is on the sleeve inner surface and substantially completely covers the sleeve inner surface. A representative suitable adhesive, water-proof coating is mastic asphalt.

Figure 2:
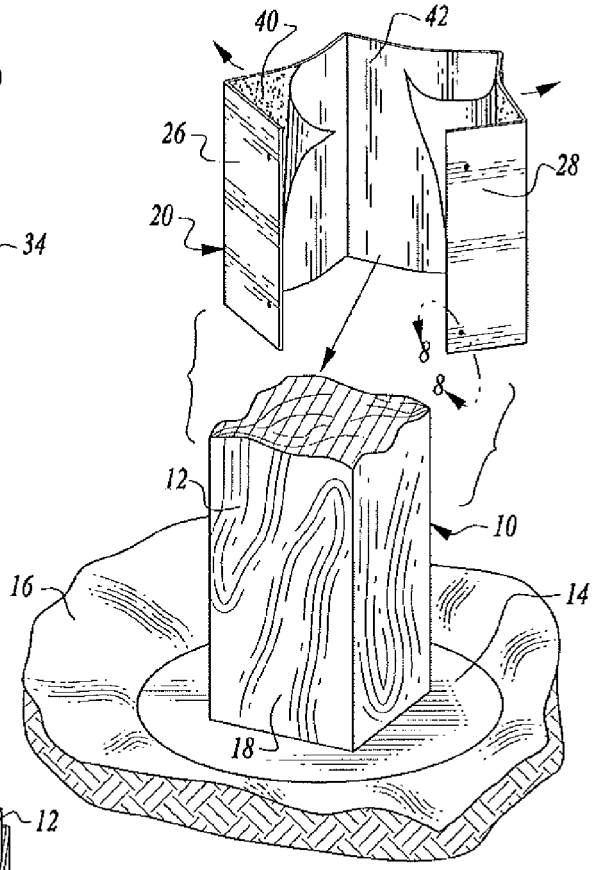
FIG. 2 is a perspective, exploded view showing a portion of a wooden fence post having the lower end thereof embedded in concrete in the ground prior to installation of the protective sleeve, the figure also illustrating the protective sheet in the process of being removed prior to installation.

A protective sheet 42 covers the adhesive, water-proof coating until the protective sleeve is to be utilized. FIGS. 2 and 8 show the protective sheet 42 in the process of being removed. FIG. 2 also illustrates the shape of the sleeve prior to application to the post. The shape shown in FIG. 2 is caused by simple manual manipulation of the protective sleeve so that it can be placed over the post.

Figure 3:
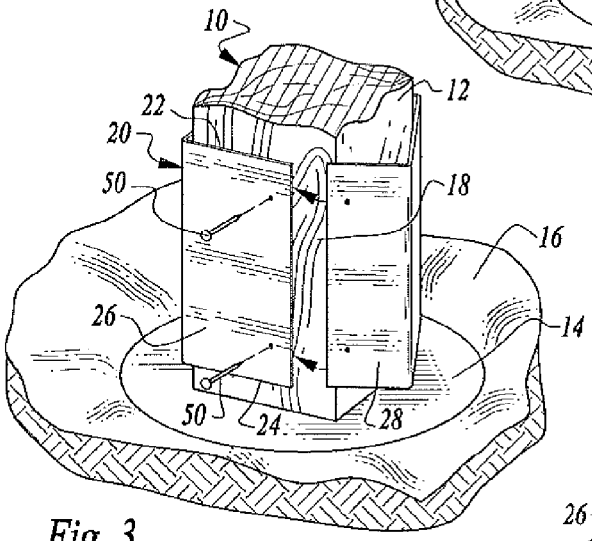
FIG. 3 is a perspective view showing the sleeve positioned on a pole portion, but prior to complete installation thereof.

FIG. 3 shows the sleeve loosely positioned on the post and preparatory to overlapping of the sleeve end segments as shown by the arrows in FIG. 3.

Figure 4:
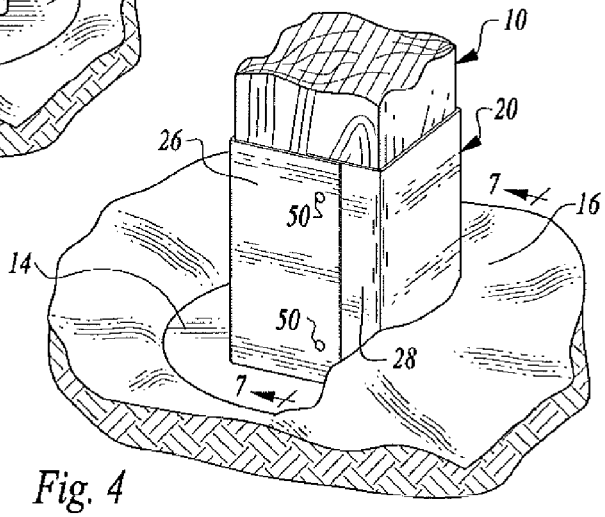
FIG. 4 is a view similar to FIG. 3, but showing the sleeve fully mounted and installed and partial back filling of dirt on the concrete.
Figure 6:
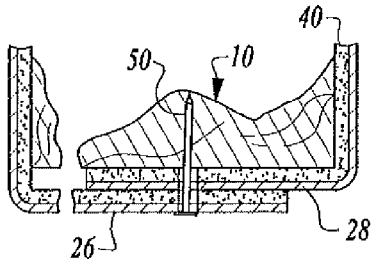
FIG. 6 is a view similar to FIG. 5, but indicating the nail fully in place and pounded the maximum amount into the post, the nail having been utilized to align the holes and tighten the sleeve about the post portion to compress the adhesive, water-proof coating and form a water-tight bond between the sleeve and the post section.
Figure 7:
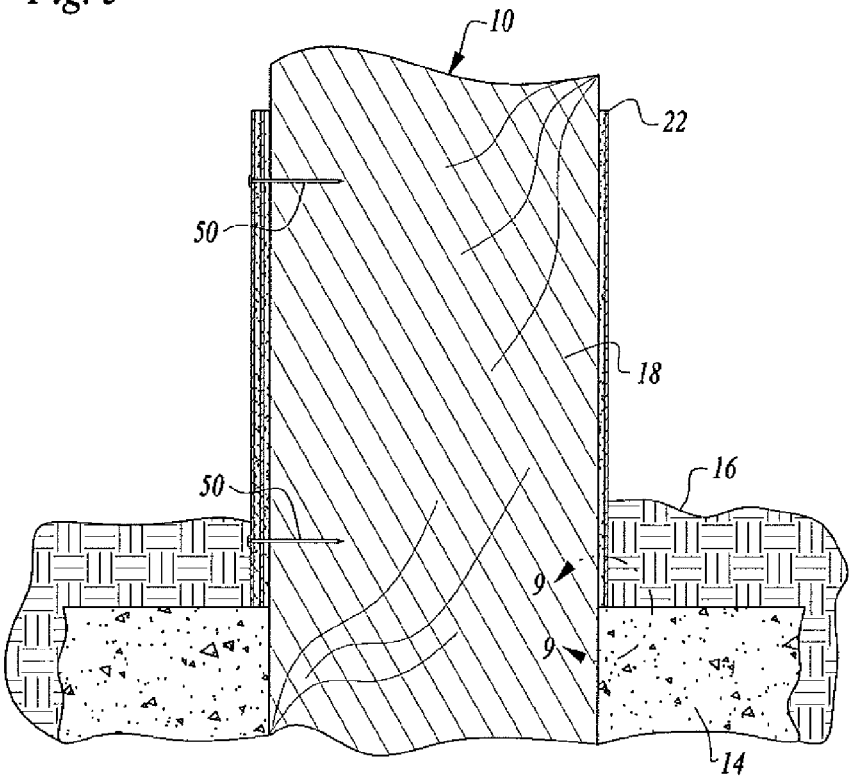
FIG. 7 is an enlarged, cross-sectional view taken along the line 7-7 of FIG. 4.

Next, the sleeve is positioned into engagement with the concrete 14 and nails 50 are employed to secure the sleeve in place relative to the post. FIGS. 4 and 7 show the heads of the fully driven nails 50 covering holes of the sleeve end segments. FIG. 7 shows the nails fully driven into the post and tightly securing the sleeve end panel segments together with the post. FIG. 6 shows this relationship in cross-section also.

Figure 5:
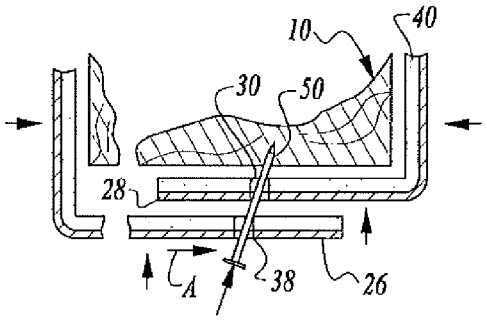
FIG. 5 is a cross-sectional, plan view showing overlapping sleeve end segments of the sleeve in positions assumed thereby relative to each other and to the post at an initial stage wherein a nail partially pounded into the projects through misaligned openings or holes in the sleeve end segments.

One of the novel features of the present invention is the use of the nails to exert opposed pulling forces on the overlapping end segments tightening the sleeve about the post portion and compressing the adhesive, water-proof coating to form a water-tight bond between the sleeve and the post portion extending from the concrete to the upper sleeve edge. FIG. 5 illustrates the initial step carried out in the process. When the sleeve is not in tight engagement with the post, the holes of the two sleeve end segments are not aligned. However, the objective is to form a tight water-proof bond between the post and the sleeve as well as form a tight adhesive bond between the sleeve end segments.

When a nail 50 is initially pounded into the post when the holes of the two sleeve end segments are non-aligned, the nail has an acute angular position relative to the post outer surface as well as with respect to the sleeve end segments. After the pointed end of the nail is introduced into the hole a lateral force (shown by arrow A in FIG. 5) is manually applied to the nail at the head area. This pivots the nail to a position where it is orthogonal to the sleeve end segments and to the post surface receiving the nails. Pounding of the nails to their final positions causes the nail heads to cover the holes 38 and to directly exert compressive forces on the adhesive, water-proof coating immediately surrounding the shanks of the nails. Therefore, a tight water-proof bond is formed between the adhesive, water-proof coating and the nail shanks. The nail heads substantially prevent outward flow of the adhesive, water-proof coating through the holes. As shown in FIG. 9, this compression causes downward flow of the mastic asphalt and forms a tight bond between the protective sleeve and the concrete as well as with the post itself. If a gap exists between the lower sleeve edge and the concrete and the void will be filled by mastic asphalt squeezed therethrough contributing to the water-tight bond.

The sleeve also functions as a termite barrier to prevent attack by subterranean termites. The invention prevents direct contact between the soil and the post.

The invention claimed is:

1. In combination:

a wooden support post having a peripheral surface of predetermined length and including a lower post end embedded in concrete positioned in the ground, the post projecting upwardly from the concrete and ground;

a protective sleeve of single piece construction formed of sheet metal extending completely about the peripheral surface of the post at a post portion located above the concrete at or immediately adjacent to the concrete, said sleeve having an upper sleeve edge and a lower sleeve edge, a sleeve inner surface and overlapping sleeve end segments, each sleeve end segment defining a plurality of holes spaced apart vertically between the upper sleeve edge and the lower sleeve edge, the holes of said sleeve end segments being in communication with one another;

an adhesive, water-proof coating on the sleeve inner surface covering said sleeve inner surface above said lower sleeve edge located between the sleeve inner surface and said post surrounding, engaging and substantially completely covering the post portion, said adhesive, water-proof coating applied to said sleeve inner surface prior to positioning of said sleeve about the peripheral surface of said post; and nails extending through the holes defined by said overlapping sleeve end segments that are in communication with one another and into said post portion exerting opposed pulling forces on said overlapping end segments tightening said sleeve about the post portion and compressing said adhesive, water-proof coating to form a water-tight bond between said sleeve and said post portion extending from said concrete toward the upper sleeve edge with said adhesive water-proof coating in engagement with said concrete and forming a water-tight bond between said sleeve and said concrete, said nails having nail shanks and nail heads, said nail heads covering the holes that are in communication with one another and exerting compressive forces on the adhesive, water-proof coating immediately surrounding the nail shanks of the nails to simultaneously form a tight water-proof bond between the adhesive, water-proof coating and the nail shanks, and the nail heads substantially preventing outward flow of the adhesive, water-proof coating through the holes that are in communication with one another.

2. The combination according to claim 1 wherein said sheet metal is galvanized sheet metal.

3. The combination according to claim 1 wherein said adhesive, water-proof coating is mastic asphalt.

4. The combination according to claim 1 additionally comprising a protective sheet covering said adhesive, water-proof coating and removed therefrom prior to adhesively attaching said adhesive, water-proof coating to said post portion.

5. A method for protecting a wooden support post having a peripheral surface of predetermined length and including a lower post end embedded in concrete positioned in the ground, the post projecting upwardly from the concrete and ground, said method comprising the steps of:

providing a protective sleeve of single piece construction formed of sheet metal having an upper sleeve edge and a lower sleeve edge, a sleeve inner surface and overlapping sleeve end segments defining a plurality of holes spaced apart vertically between the upper sleeve edge and the lower sleeve edge;

positioning said sleeve so that said sleeve extends completely about the peripheral surface of the post at a post portion located above the concrete at or immediately adjacent to the concrete with the holes of the sleeve end segments being in communication with one another;

providing an adhesive, water-proof coating on the sleeve inner surface covering the sleeve inner surface above the lower sleeve edge located between the sleeve inner surface and said post to surround, engage and substantially completely cover the post portion, said adhesive water-proof coating applied to said sleeve inner surface prior to positioning of said sleeve about the peripheral surface of said post; and extending nails through the holes defined by said overlapping sleeve end segments that are in communication with one another and pounding said nails into said post portion to exert opposed pulling forces on said overlapping end segments tightening said sleeve about the post portion and compressing said adhesive, water-proof coating to form a water-tight bond between said sleeve and said post portion extending from said concrete toward the upper sleeve edge with said adhesive water-proof coating in engagement with said concrete and forming a water-tight bond between said sleeve and said concrete, said nails having nail heads that cover said openings and employed to directly exert compressive forces on the adhesive, water-proof coating immediately surrounding the shanks of the nails to simultaneously form a tight water-proof bond between adhesive, water-proof coating and the shanks, and said nail heads employed to substantially prevent outward flow of the adhesive, water-proof coating through said holes.

6. The method according to claim 5 wherein said sheet metal is galvanized sheet metal.

7. The method according to claim 5 wherein said adhesive, water-proof coating is mastic asphalt.

8. The method according to claim 5 wherein said sleeve has a powder coated sleeve outer surface.

9. The method according to claim 5 wherein a lateral outside force is exerted on said nails during pounding of said nails to change the angular disposition of said nails and cause the nails to cause relative movement between the sleeve end segments and bring said holes into alignment.

10. The method according to claim 9 wherein said lateral outside force is exerted prior to completion of the pounding of said nails and moves said nails from an acute angular position relative to the peripheral surface and to the sleeve end segments to a substantially orthogonal position.

11. In combination:

a wooden support post having a peripheral surface of predetermined length and including a lower post end embedded in concrete positioned in the ground, the post projecting upwardly from the concrete and ground;

a protective sleeve of single piece construction formed of sheet metal having a powder coated outer surface extending completely about the peripheral surface of the post at a post portion located above the concrete at or immediately adjacent to the concrete, said sleeve having an upper sleeve edge and a lower sleeve edge, a sleeve inner surface and overlapping sleeve end segments defining holes;

an adhesive, water-proof coating located between the sleeve inner surface and said post substantially completely covering the post portion; and mechanical fastener structure extending through the holes defined by said overlapping sleeve end segments and into said post portion exerting opposed pulling forces on said overlapping end segments tightening said sleeve about the post portion and compressing said adhesive, water-proof coating to form a water-tight bond between said sleeve and said post portion extending from said concrete to the upper sleeve edge.

12. In combination:

a protective sleeve of single piece construction formed of sheet metal having a powder coated outer surface adapted for attachment to a wooden support post, said post having a peripheral surface of predetermined length and including a lower post end embedded in concrete positioned in the ground, the post projecting upwardly from the concrete and ground, said protective sleeve adapted to extend completely about the peripheral surface of the post at a post portion located above the concrete at or immediately adjacent to the concrete, said sleeve having an upper sleeve edge, a lower sleeve edge, a sleeve inner surface and sleeve end segments defining holes, said sleeve end segments overlapping when said sleeve extends completely about the peripheral surface of said post; and an adhesive, water-proof coating on said sleeve inner surface substantially completely covering the sleeve inner surface, said holes defined by said overlapping sleeve end segments for receiving nails adapted to exert opposed pulling forces on said overlapping end segments tightening said sleeve about the post portion and compressing said adhesive, water-proof coating to form a water-tight bond between said sleeve and said post portion extending from said concrete to the upper sleeve edge when said nails are driven into said post.

* * * * *